US009036841B2

(12) United States Patent
De Bruijn et al.

(10) Patent No.: US 9,036,841 B2
(45) Date of Patent: May 19, 2015

(54) SPEAKER SYSTEM AND METHOD OF OPERATION THEREFOR

(75) Inventors: Werner Paulus Josephus De Bruijn, Eindhoven (NL); William John Lamb, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 332 days.

(21) Appl. No.: 13/581,942

(22) PCT Filed: Mar. 3, 2011

(86) PCT No.: PCT/IB2011/050904
§ 371 (c)(1),
(2), (4) Date: Aug. 30, 2012

(87) PCT Pub. No.: WO2011/114252
PCT Pub. Date: Sep. 22, 2011

(65) Prior Publication Data

US 2012/0328135 A1 Dec. 27, 2012

(30) Foreign Application Priority Data

Mar. 18, 2010 (EP) ..... 10156855

(51) Int. Cl.

| | |
|---|---|
| ***H04R 5/02*** | (2006.01) |
| ***H04R 3/12*** | (2006.01) |
| ***H04R 1/32*** | (2006.01) |
| ***H04S 7/00*** | (2006.01) |

(52) U.S. Cl.
CPC ..... *H04R 3/12* (2013.01); *H04R 1/323* (2013.01); *H04R 2203/12* (2013.01); (Continued)

(58) Field of Classification Search
CPC ..... H04R 5/00; H03G 5/00
USPC ..... 381/98–99, 63, 103, 17, 77–78
See application file for complete search history.

(56) References Cited

U.S. PATENT DOCUMENTS 5,809,150 A * 9/1998 Eberbach ..... 381/300
7,315,619 B2 1/2008 Marton et al.

(Continued)

FOREIGN PATENT DOCUMENTS

EP 1694097 A1 8/2006
JP 2007081775 A 3/2007

(Continued)

OTHER PUBLICATIONS

Pompei: "Sound From Ultrasound:The Parametic Array as an Audible Sound Source"; PhD Thesis, Jun. 2002, The Massachusetts Institute of Technology, 132 Page Document.

*Primary Examiner* — Disler Paul

(57) ABSTRACT

A speaker system includes a first speaker (203) and a second speaker (205). A driving circuit receives an audio signal and has a first drive circuit (209) generating a first drive signal for the first speaker (203) in response to a first filtering of the audio signal with a first passband. A second drive circuit (211) generates a second drive signal for the second speaker (205) in response to a second filtering having a second passband which includes a frequency band below the first passband. A delay (213) delays the second drive signal relative to the first drive signal. The sound from the second speaker is directionally radiated with a directional radiation pattern having a notch towards the listening position (111). The system uses the precedence effect and non-direct low frequency audio radiation to ensure that directional cues are predominantly provided by the first speaker (203) which may be small and positioned remote from the second speaker (205).

15 Claims, 4 Drawing Sheets

(52) U.S. Cl.
CPC ..... *H04R 2217/03* (2013.01); *H04R 2430/25* (2013.01); *H04R 2499/15* (2013.01); *H04S 7/302* (2013.01); *H04S 2420/05* (2013.01); *H04S 2420/07* (2013.01)

(56) References Cited

U.S. PATENT DOCUMENTS

| | | | | |
|---|---|---|---|---|
| 7,529,376 | B2 | 5/2009 | Konagai | |
| 7,606,377 | B2 * | 10/2009 | Melanson | 381/97 |
| 7,760,891 | B2 * | 7/2010 | Biegelsen | 381/92 |
| 8,311,240 | B2 * | 11/2012 | Inoue et al. | 381/99 |
| 8,538,036 | B2 * | 9/2013 | Pompei | 381/85 |
| 2007/0076894 | A1 | 4/2007 | Inoue et al. | |
| 2007/0253575 | A1 * | 11/2007 | Melanson | 381/97 |

FOREIGN PATENT DOCUMENTS

| | | | |
|---|---|---|---|
| WO | 0123104 | A2 | 4/2001 |
| WO | 2007127757 | A2 | 11/2007 |

* cited by examiner

SPEAKER SYSTEM AND METHOD OF OPERATION THEREFOR

FIELD OF THE INVENTION

The invention relates to a speaker system and method of operation therefor, and in particular, but not exclusively, to a speaker system for a rear channel of a surround sound system.

BACKGROUND OF THE INVENTION

In recent years, spatial sound provision has become increasingly popular such as, e.g., evidenced by the wide popularity of various surround sounds systems. For example, the increased popularity of home cinema systems has resulted in surround sound systems being common in many private homes. However, a problem with conventional surround sound systems is that they require a high number of separate speakers located at specific positions.

For example, a conventional Dolby 5.1 surround sound system requires right and left rear speakers, as well front center, right and left speakers. In addition, a low frequency subwoofer may be used.

The high number of speakers not only increases cost but also results in reduced practicality and increased inconvenience to users. In particular, it is generally considered a disadvantage that loudspeakers at specific positions in front as well as to the rear of listeners are needed. The rear loudspeakers are particularly problematic due to the required wiring and the physical impact they impose on the interior of the room.

In order to mitigate this problem, research has been undertaken in order to generate speaker sets that are suitable for reproducing or emulating surround sound systems but use a reduced number of speaker positions. Such speaker sets use directional sound radiation to direct sounds in directions that will result in them reaching the user via reflections from objects in the sound environment. For example, audio signals can be directed so that they will reach the listener via reflections of sidewalls thereby providing an impression to the listener that the sound originates to the side (or even behind) the listener.

However, such approaches of providing virtual sound sources tend to be less robust than real sources positioned to the rear of the listener, and tend to provide reduced audio quality and a reduced spatial experience. Indeed, it is often difficult to accurately direct audio signals to provide the desired reflections that achieve the desired virtual sound source position. Furthermore, the audio signals intended to be received from the back of the listener also tend to reach the listener via direct paths or alternative unintended paths thereby degrading the spatial experience.

Indeed, it has been identified that one of the highest preferences of consumers of, e.g., home cinema and surround systems is that of obtaining a convincing surround experience with as few and small loudspeaker units as possible. Preferably, consumers would like to be able to have a great immersive experience using only a single compact system. In order to address such preferences, loudspeaker arrangements have been developed where a plurality of spatial channels can be generated from a single loudspeaker box. This is typically achieved by the loudspeaker box comprising a plurality of speaker drivers that are individually driven with different weights for each speaker driver. This allows directional audio beams to be formed and may, e.g., be used to direct surround sound channels towards the side so that they will reach the listening position from the side or back due to reflections of walls.

However, although such approaches are often able to create a pleasant wide, spacious sound experience, they do tend to be suboptimal in providing a spatial surround sound experience. For example, they tend to be dependent on the specific audio environment and, e.g., the presence of suitable walls off of which to reflect sound. As a consequence, such systems may, in some scenarios, tend to not provide an accurate and highly realistic impression of sound reaching the listener from behind.

Therefore, it is generally the case that in order to obtain an optimal spatial user experience, the use of loudspeakers located to the side or rear of the user is typically desired. However, whereas improved performance may often be achieved by positioning of surround speakers, e.g., to the side or behind the listening position, such speakers tend to be considered undesirable. Therefore, it is desired that speakers of, e.g., a surround sound system are as small as possible and this has, for example, led to the typical arrangement of relatively small spatial (satellite) speakers combined with a single subwoofer. However, such an approach tends to not provide optimal sound quality. In addition, the spatial experience tends to be degraded as the presence of the subwoofer tends to obscure or confuse the spatial cues perceived by the listener. Furthermore, in order to provide a reasonable sound quality and spatial experience, the cross-over frequency between the subwoofer and the spatial speakers must be kept relatively low. This results in the spatial speakers needing to be of a certain size in order to provide acceptable audio quality and sound pressure towards the lower frequencies.

Hence, an improved speaker system would be advantageous and, in particular, a system that will allow facilitated implementation, facilitated setup, a reduced number and/or size of speakers, an improved spatial experience, improved audio quality and/or improved performance would be advantageous.

SUMMARY OF THE INVENTION

Accordingly, the subject invention seeks to preferably mitigate, alleviate or eliminate one or more of the above mentioned disadvantages singly or in any combination.

According to an aspect of the invention, there is provided a speaker system comprising a first speaker arranged to reproduce sound in response to a first drive signal, the first speaker being arranged to reproduce sound to arrive at a listening position; a second speaker arranged to reproduce sound in response to a second drive signal; a driving circuit comprising a receiver for receiving an audio signal for reproduction, a first drive circuit for generating the first drive signal in response to a first filtering of the audio signal, the first filtering having a first passband, a second drive circuit for generating the second drive signal in response to a second filtering of the audio signal, the second filtering having a second passband, the second passband comprising a frequency band below the first frequency band; a delay for delaying the second drive signal relative to the first drive signal; and wherein the second speaker is arranged to directionally radiate sound from the second speaker with an directional radiation pattern having a notch towards the listening position.

The inventors' have realized specific characteristics of human perception of direction for audio signals that may be used to provide a speaker system allowing improved audio performance using smaller and/or fewer speakers. In particular, an accurate spatial sound source localization may be achieved using a very small speaker while at the same time providing a sound quality which is not limited to the characteristics of the very small speaker.

Specifically, in many embodiments, the directional cues provided to a user may be dominated by the spatial position of the first speaker while allowing a large part of the audio quality to be provided by the second speaker. The system seeks to concentrate significant human spatial cues at the first speaker while providing significant audio quality cues from the second speaker.

Specifically, the system may use a psychoacoustic phenomenon known as the so-called "precedence effect" (or Haas effect) in combination with an increased diffused audio perception of sound from the second speaker to concentrate spatial cues to the first speaker.

The precedence effect represents the phenomenon that when the same sound signal is received from two sources at different positions and with a sufficiently small delay, the sound is perceived to come only from the direction of the sound source that is ahead, i.e., from the first arriving signal. Thus, the psychoacoustic phenomenon refers to the fact that the human brain derives most spatial cues from the first received signal components. The inventor's have realized that the precedence effect may also be used for scenarios where different speakers do not radiate the same signal but radiate different frequency bands of the same signal.

The use of directional lower frequency sound provision increases the strength of the precedence effect and allows the relative weight of the second speaker to be increased substantially while still maintaining a desired spatial perception. For example, it may allow the second speaker to cover a larger frequency range and/or to be used at higher relative levels thereby providing an improved sound quality. The reduced frequency range that needs to be covered by the first speaker may allow a substantial reduction in size and power. The first speaker may, for example, be a very small tweeter.

The first and/or second speaker may comprise a plurality of speaker elements or drivers.

The system may, for example, allow very small rear loudspeakers in a surround sound setup while still providing high audio quality and an accurate spatial experience.

In accordance with an optional feature of the invention, an angle between a direction from the listening position to the first speaker and a direction from the listening position to the second speaker is no less than 60 degrees.

The invention may reproduce audio using two different loudspeakers while only requiring one loudspeaker to be placed to provide desired spatial cues. Thus, the invention may, in many embodiments, allow a high degree of flexibility in positioning of speakers and may, in particular, allow the two speakers to be positioned at substantially different directions from the listening position while still allowing a single sound source to be perceived.

In some embodiments, the angle may advantageously be no less than 90 degrees.

In accordance with an optional feature of the invention, the audio signal is a signal of a surround channel of a surround sound multi-channel audio signal and the first speaker is arranged such that the sound from the first speaker arrives at the listening position from a non-frontal direction.

The invention may provide an advantageous speaker system for a surround channel of a surround sound system and may, in particular, allow accurate spatial surround reproduction while only requiring that very small speakers are positioned to provide the required spatial cues.

A non-frontal direction may specifically be a direction which is no less than 60 degrees offset relative to a direction from the listening position to a center front position of the surround sound system setup.

In accordance with an optional feature of the invention, the first speaker is part of a surround sound system and is positioned outside a front direction angle interval for the surround sound system, the front direction interval comprising angles less than 60 degrees offset relative to a direction from the listening position to a surround sound center channel audio source.

The invention may provide an advantageous speaker system for a surround channel of a surround sound system and may, in particular, allow accurate spatial surround reproduction and high audio quality while requiring only very small speakers to be positioned to provide the required spatial cues.

In accordance with an optional feature of the invention, an intensity of audio from the second speaker in the direction of the listening position is no less than 10 dB below a maximum intensity of the audio from the second speaker.

This may provide an advantageous effect and may, in particular, provide a suitable attenuation of the direct path for the second speaker to suitably enhance the precedence effect. In some embodiments, the intensity may advantageously be no less than 20 dB below the maximum intensity.

In accordance with an optional feature of the invention, the first passband has a lower 3 dB cut-off frequency that belongs to a frequency range of 400 Hz to 1 kHz.

This may, in many embodiments, provide an improved performance. In particular, an advantageous trade-off between audio quality and spatial perception may be achieved. In some embodiments, the lower 3 dB cut-off frequency may advantageously be no less than 600 Hz, 700 Hz or 800 Hz.

In accordance with an optional feature of the invention, the first passband has a lower 3 dB cut-off frequency of no more than 1000 Hz. This may allow an improved precedence effect and reduce the risk of the first speaker not providing enough signal to provide the desired spatial cues.

In accordance with an optional feature of the invention, the second passband has a higher 3 dB cut-off frequency of no less than 500 Hz.

This may, in many embodiments, provide an improved performance. In particular, an advantageous trade-off between audio quality and spatial perception may be achieved. In some embodiments, the higher 3 dB cut-off frequency may advantageously be no less than 600 Hz, 700 Hz or 800 Hz.

In accordance with an optional feature of the invention, the second passband has a higher 3 dB cut-off frequency of no more than 1000 Hz. This may allow an improved precedence effect and reduce the risk of the first speaker not providing enough signal to provide the desired spatial cues.

In accordance with an optional feature of the invention, a frequency of equal gain for the first passband and the second passband belongs to a frequency range of 400 Hz to 1 kHz.

This may, in many embodiments, provide an improved performance. In particular, an advantageous trade-off between audio quality and spatial perception may be achieved. In some embodiments, particularly advantageous performance is found for the frequency of equal gain being in the range of 700 Hz to 900 Hz.

In accordance with an optional feature of the invention, the first filtering is a high-pass filtering and the second filtering is a low-pass filtering.

This may provide particularly advantageous performance and/or may facilitate implementation.

In accordance with an optional feature of the invention, the delay is arranged to delay the second drive signal relative to the first drive signal by no more than 40 msec. more than a transmission path delay difference between a transmission path from the first speaker to the listening position and a direct path from the second speaker to the listening position.

This may provide improved performance and may, in particular, provide a reproduced audio signal that is substantially perceived to be a single source in the direction of the first speaker. Thus, it may allow the first and second speakers to appear as a single loudspeaker positioned in the direction from which the sound from the first speaker is received. The feature may allow a particularly robust precedence effect to be achieved. In some embodiments, improved performance may be achieved for a corresponding relative delay of less than 16 msec., or even less than 5 msec.

In accordance with an optional feature of the invention, the first speaker comprises a parametric speaker.

This may provide a particularly strong spatial experience in many embodiments and may allow a very small form factor implementation of the first speaker.

In accordance with an optional feature of the invention, the second speaker comprises a plurality of audio drivers, and the second drive circuit is arranged to generate the second drive signal as individual phase offset signals for the plurality of audio drivers to provide a directional radiation pattern.

This may provide a particularly advantageous implementation and operation. In particular, it may allow a low complexity and highly efficient approach to attenuating the direct path for lower frequencies thereby strengthening the precedence effect. The phase offsets may be fixed and static or may be dynamically updated. Thus, the plurality of audio drivers may provide a fixed directional beam or may provide a dynamically steerable beam.

In accordance with an optional feature of the invention, the first speaker is integrated in an audiovisual reproduction device whereas the second speaker is remote from the audiovisual reproduction device.

This may provide a particularly desirable user experience in many environments. It may, for example, allow a system wherein a form factor restricted device can provide audio that is spatially perceived to originate from the device without requiring the sound quality to be restricted by the physical dimensions of the device.

In accordance with an optional feature of the invention, the speaker system further comprises: an estimator for dynamically generating a direction estimate for a direction from the second speaker to the listening position; and a controller for modifying the directional radiation pattern to provide the notch in the estimated direction.

This may provide improved performance in many scenarios and may provide increased flexibility and adaptation of the system to the specific environment.

In accordance with an optional feature of the invention, the speaker system further comprises: a user input for receiving a direction indication from a user; and a controller for modifying the directional radiation pattern to provide the notch in a direction indicated by the direction indication.

This may provide improved performance in many scenarios and may provide increased flexibility and customization of the system to the specific environment.

According to an aspect of the invention, there is provided a method of operation for a speaker system including a first speaker arranged to reproduce sound in response to a first drive signal, the first speaker being arranged to reproduce sound to arrive at a listening position; a second speaker arranged to reproduce sound in response to a second drive signal; the method comprising: receiving an audio signal for reproduction, generating the first drive signal in response to a first filtering of the audio signal, the first filtering having a first passband, generating the second drive signal in response to a second filtering of the audio signal, the second filtering having a second passband, the second passband comprising a frequency band below the first frequency band; delaying the second drive signal relative to the first drive signal; and wherein the sound from the second speaker is directionally radiated with a directional radiation pattern having a notch towards the listening position.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to a surround sound system and, in particular, to a system with five spatial channels. However, it will be appreciated that the invention is not limited to this application, but may be applied to many other audio reproduction systems including, for example, a single audio channel system.

Figure 1:
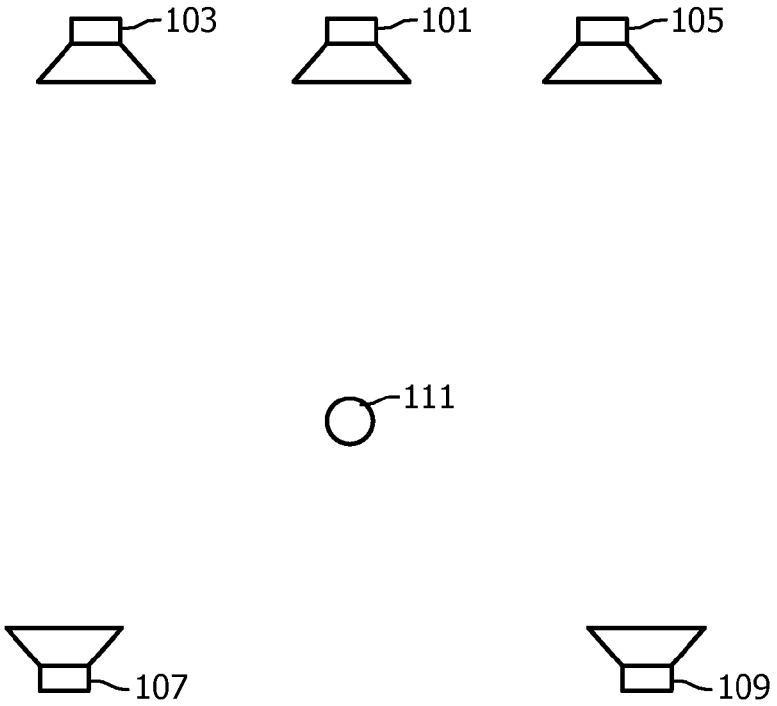
FIG. 1 illustrates a speaker system setup in a conventional five channel surround sound system.

FIG. 1 illustrates a speaker system setup in a conventional five channel surround sound system, such as a home cinema system. The system comprises a center speaker 101 providing a center front channel, a left front speaker 103 providing a left front channel, a right front speaker 105 providing a right front channel, a left rear speaker 107 providing a left rear channel, and a right rear speaker 109 providing a right rear channel. The five speakers 101-109 together provide a spatial sound experience at a listening position 111 and allow a listener at this location to experience a surrounding and immersive sound experience. In many home cinema systems, the system may further include a subwoofer for a Low Frequency Effect (LFE) channel.

The requirement for a large number of loudspeakers and for these to be located to the side or behind the listening position is typically considered inconvenient by consumers.

This is particularly disadvantageous for products like home cinema systems which are intended to have a broad appeal and application in environments that are not optimized for or dedicated to the sound experience.

This is further exacerbated by the trade-off between sound quality and size, etc., of the speakers. Indeed, it is desirable for, in particular, the surround speakers to be small such that they can be discrete and inconspicuous. However, in order to provide a suitable sound quality and sound pressure level at especially lower frequencies, conventional surround speakers are typically limited in how small they can be.

In the following, approaches will be described that allows sound reproduction for an audio signal to be provided by at least two speakers where one speaker is significant in providing the spatial cues whereas the other speaker is significant in providing low frequency audio quality. In many embodiments, a very small high frequency speaker may dominate the spatial perception whereas a larger low frequency speaker may dominate the low frequency audio quality. Thus, the system may allow the positioning of only a very small speaker determining the spatial position without the audio quality being limited to that which can be achieved from such a small loudspeaker. The approach may, for example, be advantageous for surround channels of a surround sound system such as that of FIG. 1.

Figure 2:
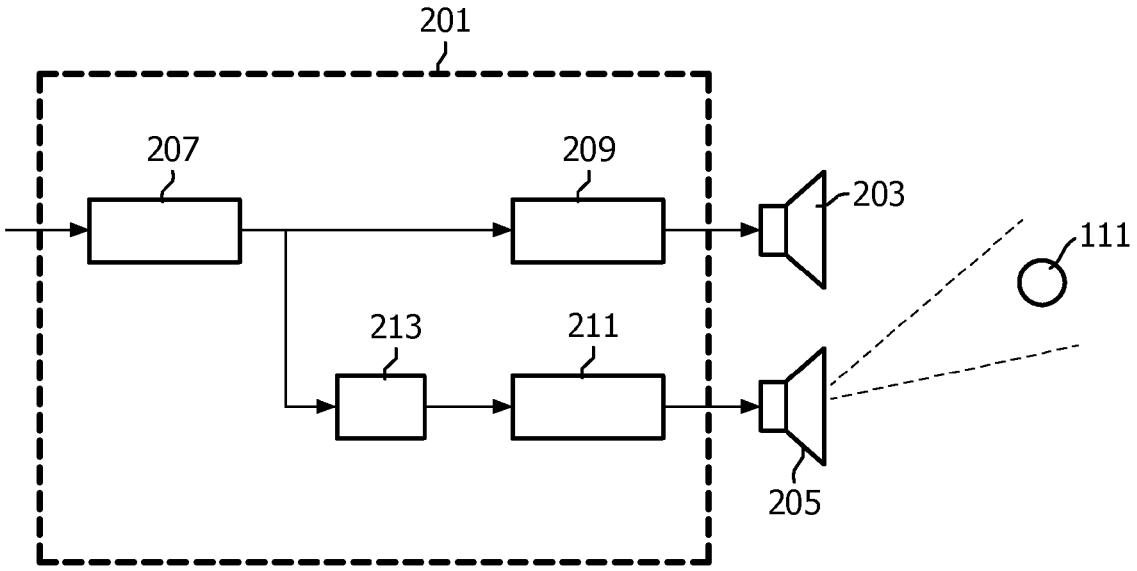
FIG. 2 illustrates an example of elements of a speaker system in accordance with some embodiments of the invention.

FIG. 2 illustrates an example of a speaker system in accordance with some embodiments of the invention.

The speaker system comprises a drive circuit 201 which receives a (mono) audio signal and reproduces it using two speakers 203, 205. The audio signal may, for example, represent a channel of a multi-channel signal, such as a rear surround channel of a surround sound system.

In the example, the first speaker 203 is a small high frequency loudspeaker such as, e.g., a tweeter, and will be henceforth be referred to as the high frequency loudspeaker 203. The second speaker 205 is a larger low frequency loudspeaker which will henceforth be referred to as the low frequency loudspeaker 205. The high frequency loudspeaker 203 is arranged to reproduce sound such that it arrives at the listening position predominantly from a given direction. Thus, the high frequency loudspeaker 203 is arranged to provide a signal which has spatial cues corresponding to the sound arriving from the given direction.

It will be appreciated that each of the speakers 203, 205 may be implemented by a plurality of drive units and may, e.g., include passive sound radiators such as a bass reflex port or a passive drive unit.

The drive circuit 201 comprises a receiver 207 which receives the audio signal from a suitable internal or external source. For example, the audio signal may be received from a surround sound decoder. The audio signal is an electrical signal and may be provided as an analog or digital, time continuous or time discrete (sampled) signal.

The receiver 207 is coupled to a first drive circuit, henceforth referred to as the high frequency drive circuit 209, which is further coupled to the high frequency loudspeaker 203. The high frequency drive circuit 209 is arranged to generate a first drive signal for the high frequency loudspeaker 203 from the audio signal. The high frequency drive circuit 209 includes a filtering as part of the process such that only part of the frequency spectrum of the audio signal is fed to the high frequency loudspeaker 203. In many embodiments, the filtering is a high-pass filtering having a passband covering frequencies above a given cut-off frequency, such as, e.g., a 3 dB cut-off frequency. However, it will be appreciated that in other embodiments the high frequency drive circuit 209 may effectively provide a band-pass filtering, e.g., by attenuating very high frequencies (such as frequencies above the audio range).

Thus, the high frequency drive circuit 201 drives the high frequency loudspeaker 203 to reproduce the higher frequencies of the audio signal. The generated signal comprises strong spatial cues and thus a very small speaker may provide a strong spatial experience.

It will be appreciated that the high frequency drive circuit 209 may further comprise other signal processing functions such as, e.g., amplification, digital-to-analog conversion, etc. The high frequency drive circuit 209 may be implemented in any suitable form including, e.g., digital signal processors, analog amplification circuits, etc. Typically, the high frequency drive circuit 209 will comprise a combination of digital signal processing functionality (such as executable code running on a suitable processing platform, such as, e.g., a digital signal processor) and analog processing functionality (such as an analog audio power amplifier). However, it will be appreciated that the high frequency drive circuit 209 may be implemented entirely as executable code (e.g., using a digital interface to the first speaker 203) or as analog circuitry.

The receiver 207 is further coupled to a second drive circuit 211 via a delay 213. The second drive circuit 211 is henceforth referred to as the low frequency drive circuit 211 and is arranged to generate a second drive signal for the low frequency loudspeaker 205 from the audio signal. The low frequency drive circuit 211 includes a filtering as part of the process such that only part of the frequency spectrum of the audio signal is fed to the low frequency loudspeaker 205. In many embodiments, the filtering is a low-pass filtering having a passband covering frequencies below a given cut-off frequency, such as, e.g., a 3 dB cut-off frequency. However, it will be appreciated that in other embodiments the low frequency drive circuit 211 may effectively provide a band-pass filtering, e.g., by attenuating very low frequencies (such as frequencies below the audio range).

It will be appreciated that the low frequency drive circuit 211 may further comprise other signal processing functions such as, e.g., amplification, digital-to-analog conversion, etc. The low frequency drive circuit 211 may be implemented in any suitable form including, e.g., digital signal processors, analog amplification circuits, etc. Typically, the low frequency drive circuit 211 will comprise a combination of digital signal processing functionality (such as executable code running on a suitable processing platform, such as, e.g., a digital signal processor) and analog processing functionality (such as an analog audio power amplifier). However, it will be appreciated that the low frequency drive circuit 211 may be implemented entirely as executable code (e.g., using a digital interface to the second speaker 205) or as analog circuitry.

The passband for the low frequency drive circuit 211 will include at least one frequency interval which is below the passband of the high frequency drive circuit 209. In many embodiments, the passbands may be complementary with the low frequency drive circuit 211 covering lower frequencies and the passband of the high frequency drive circuit 209 covering higher frequencies. For example, the filtering of the drive circuits 209, 211 may be such that the low frequency drive circuit 211 has a higher gain for frequencies below a given cut-off frequency whereas the high frequency drive circuit 209 has a higher gain for frequencies above the cut-off frequency (the gains may, e.g., be compensated for differences in the efficiencies of the first and second speakers 203, 205).

In some embodiments, the passband of the low frequency drive circuit 211 may overlap the passband for the high frequency drive circuit 209, but it will still include at least one frequency range that is not included in this higher pass band.

Thus, the speaker system uses a two loudspeaker design with the reproduced audio being provided by a small high frequency loudspeaker 203 and large low frequency loudspeaker 205. However, the approach further uses techniques to ensure that the high frequency loudspeaker 203 provides much stronger and typically dominating directional cues than the low frequency loudspeaker 205.

In particular, the delay 213 is introduced to delay the low frequency drive signal relative to the high frequency drive signal. The delay is set to a value for which a precedence effect is achieved so that the spatial perception is dominated by the high frequency loudspeaker 203. This precedence (or Haas) effect occurs when two loudspeakers radiate the same signal but with one signal being received with a short delay relative to the other. The effect generally occurs for a relative delay in the range from about 1 msec. to an upper limit of typically 5-40 msec. In such a situation, the sound is perceived to be arriving from the direction of the undelayed loudspeaker. The inventors have realized that this effect is not only limited to situations where the same signal is radiated from the two loudspeakers but may also be achieved for systems wherein the different loudspeakers radiate different frequency ranges of the same audio signal. For example, where one loudspeaker reproduces all frequencies below a certain cross-over frequency and another loudspeaker reproduces all frequencies above the cross-over frequency.

The radiation of sound from the low frequency loudspeaker 205 is furthermore a directional sound radiation with a directional radiation pattern having a notch towards the listening position 111. The listening position may be a nominal, virtual or assumed listening position. The notch corresponds to a reduced intensity of audio being radiated in the direction towards the listening position 111 and thus the lower frequency audio will tend to reach the listening position via indirect paths (such as reflections off walls and ceilings) and will accordingly provide a more diffuse sound to the listener.

Such diffused sound tends to reduce the spatial perception cues and accordingly works with the precedence effect to reduce the spatial perception of the low frequency loudspeaker 205 relative to the high frequency loudspeaker 203. In particular, the two effects have been found to combine to provide a spatial perception that is dominated by the sound from the high frequency loudspeaker 203 even for relatively large proportions of the total audio being produced by the low frequency loudspeaker 205. Thus, a system is achieved wherein the spatial perception is dominated by a small high frequency speaker while allowing improved sound quality at lower frequencies due to the use of a larger low frequency speaker which can be positioned relatively freely.

The inventors have specifically found that the robustness of the psychoacoustic precedence perception (i.e., the degree to which all sound seems to come from the location of the high-frequency sound) depends on several system parameters, most notably the level balance between the two loudspeakers, and the cross-over frequency between them. E.g., if the level of the low-frequency loudspeaker is set too high, it becomes noticeable that the low-mid frequencies are coming from this speaker. So, two separate sources are perceived in this case, which is undesirable. Similarly, when the cross-over frequency is set too high, the same effect occurs.

In the current approach, rather than using a single conventional loudspeaker (which is essentially omni-directional) for low frequencies, a loudspeaker with a directional radiation pattern having a notch (and specifically a 'null') in the direction of the listening position (111) is used. As a consequence, the amount of direct sound from the low-frequency loudspeaker 205 reaching the listener is minimized. The majority of the low-frequency sound reaches the listener indirectly, via reflections at the walls. This results in the low-frequency audio being more diffuse, and thus the directional perception is substantially reduced. In particular, the sound is much less perceived to originate from the position of the low frequency loudspeaker 205. This may be achieved while maintaining the same total amount of low-frequency sound being radiated.

Effectively, this means that with a given level balance between the high frequency loudspeaker 203 and the low frequency loudspeaker 205, the robustness of the precedence effect will be significantly larger. This will, for example, allow that for a given degree of robustness of the effect, the level of the low-frequency sound can be increased, resulting in a more "full" sound experience. Thus, the spatial perception, audio quality or both may be improved significantly by the interaction of the precedence effect and the directional low frequency sound radiation.

It will be appreciated that any suitable way of providing a directional sound output from the low frequency loudspeaker 205 may be used without subtracting from the invention. For example, the low frequency loudspeaker 205 may use a single drive unit designed or mounted such that it has a directional characteristic.

Figure 3:
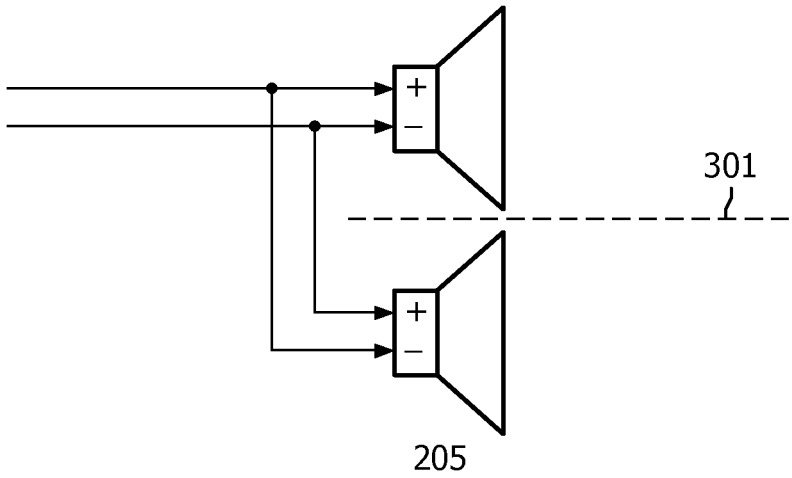
FIG. 3 illustrates an example of elements of a directional loudspeaker.
Figure 4:
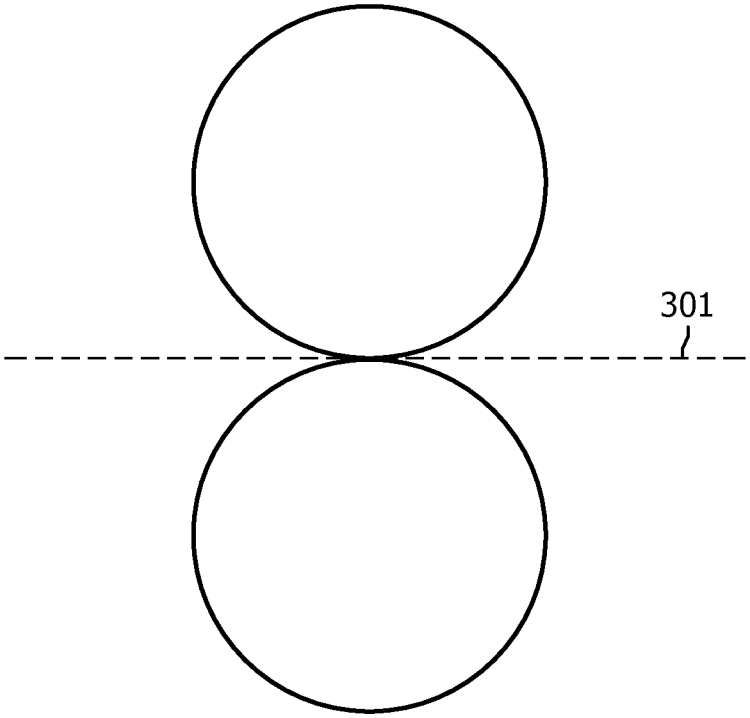
FIG. 4 illustrates an example of a sound radiation pattern for a directional loudspeaker.

In the specific example, the low frequency loudspeaker 205 is constructed using two driver units that are driven with opposite phases, as illustrated in FIG. 3. It is known in the field that such an arrangement results in a directional radiation pattern corresponding to a dipole as illustrated in FIG. 4. Thus, the arrangement provides a null along the central axis 301 of the low frequency loudspeaker 205. The low frequency loudspeaker 205 may accordingly be positioned such that this axis points towards the listening position 111.

It will be appreciated that the notch may indeed be a null in the directional radiation pattern provided by the low frequency loudspeaker 205 but need not be so. It will also be appreciated that the direction of the notch need not be directly aligned with the direction to the listening position but may simply be sufficiently close for the notch to provide a suitable attenuation of sound radiated along the direct path from the low frequency loudspeaker 205 to the listening position 111.

Indeed, the notch may provide a suitable attenuation in the direction of the listening position 111 relative to a maximum beam gain/intensity such that the sound from the low frequency loudspeaker 205 is predominantly received indirectly. In many embodiments, the arrangement may be such that the notch provides no less than 10 dB attenuation of the radiated sound in the direction of the listening position relative to a direction of maximum intensity. In some embodiments, advantageous performance may be achieved by the notch providing at least 20 dB attenuation.

In some embodiments using multiple drivers as exemplified by FIG. 3, the low frequency loudspeaker 205 may be angled towards the listening area 111 in order to provide an increased attenuation of the direct path. However, in other embodiments, a fixed phase offset may be applied to one of the drivers. Such a phase offset results in the angle of the null being modified and the loudspeaker may accordingly be modified to provide increased attenuation along a suitable angle which is not perpendicular to the axis along which the drivers are aligned.

Depending on the specific characteristics of the audio environment and the specific scenario, it may be advantageous to have a relatively narrow notch or a relatively wide notch. However, in many embodiments, the width of the notch may advantageously be between 5 degrees and 90 degrees measured for a 10 dB attenuation relative to the maximum intensity. This may in many scenarios provide an advantageous trade-off between the desire to spread the low frequency sound in the audio environment and the desire to sufficiently attenuate the direct path without requiring accurate alignment between the low frequency loudspeaker 205 and the listening position 111. In many embodiments, the angle may even more advantageously be between 20 degrees and 70 degrees.

In many embodiments, the transfer function of the low frequency drive circuit 211 has a low-pass transfer characteristic and thus the filtering of the low frequency drive circuit 211 may correspond to a low-pass filtering. Similarly, the transfer function of the high frequency drive circuit 209 may have a high-pass transfer characteristic and thus the filtering of the high frequency drive circuit 209 may correspond to a high-pass filtering.

The passband of the low frequency drive circuit 211 may accordingly be a low passband and the passband of the high frequency drive circuit 209 may be a high passband. The two drive circuits 209, 211 may thus together represent the signal with the low frequency loudspeaker 205 reproducing the lower frequencies and the high frequency loudspeaker 203 reproducing the higher frequencies. The two passbands may have a cross-over frequency that can be measured as the frequency for which the two paths (e.g., of the drive circuits 209, 211 including the efficiency of the loudspeakers 203, 205) are identical. This cross-over frequency may thus be seen as the frequency at which the dominant speaker changes between the low frequency loudspeaker 205 and the high frequency loudspeaker 203.

In many embodiments, the cross-over frequency is advantageously in the frequency range of 400 Hz to 1 kHz. This typically provides a highly advantageous trade-off between the required size of the high frequency loudspeaker 203, the audio quality and the spatial experience. In particular, for most signals, it ensures that a sufficient proportion of the signal is reproduced by the high frequency loudspeaker 203 thereby providing sufficient spatial cues for the precedence effect while, at the same time, ensuring that a sufficient proportion of the signal is reproduced by the low frequency loudspeaker 205 such that high overall audio quality is achieved even for a very small high frequency loudspeaker 203.

In many scenarios particularly advantageous trade-offs are found for a crossover frequency in the frequency range of 700 Hz-900 Hz and in particular at substantially 800 Hz. This has been found to, in many scenarios, provide the highest proportion of sound being reproduced by the low frequency loudspeaker 205 without resulting in unacceptable degradation of the spatial experience. It may thus, in many scenarios, allow a particularly small high frequency loudspeaker 203.

It will be appreciated that in some embodiments, the two passbands may be overlapping and in such cases, the cross-over frequency may be considered to be any frequency within the overlapping frequency range.

Also, the passbands may be characterized by their cut-off frequencies. In particular, the upper (highest frequency) 3 dB cut off frequency of the passband for the low frequency drive circuit 211 may be determined. Similarly, the lower (lowest frequency) 3 dB cut off frequency of the passband for the high frequency drive circuit 209 may be determined. Thus, the upper 3 dB cut-off frequency may be considered the highest frequency handled by the low frequency loudspeaker 205 and the lower 3 dB cut-off frequency may be considered the lowest frequency handled by the high frequency loudspeaker 203. It will be appreciated that these two cut-off frequencies need not be coinciding and indeed that the upper 3 dB cut-off frequency for the low frequency loudspeaker 205 may be higher or lower than the lower 3 dB cut-off frequency for the high frequency loudspeaker 203 depending in the preferences of the individual embodiment (e.g., allowing an overlap or gap between the pass bands).

The cut-off frequencies are advantageously in the frequency range from 400 to 1 kHz, and even more advantageously in the frequency range from 700-900 Hz. As described for the cross-over frequency range, this may provide a particularly advantageous trade-off in many embodiments.

In the approach, the delay 213 is set such that the signal from the high frequency loudspeaker 203 is received slightly before the signal from the low frequency loudspeaker 205 thereby introducing the precedence effect.

In order to achieve an optimum precedence effect, the delay 213 may be set to reflect the specific properties of the audio environment. In particular, a delay $\tau$ may be applied which comprises two components. The first delay component $\tau t1$ compensates for the travel time difference due to the different path lengths to the listener's ears for sound waves originating from the high frequency loudspeaker 203 and the low frequency loudspeaker 205, respectively.

Applying this delay results in the sound from the high frequency loudspeaker 203 and the low frequency loudspeaker 205 arriving at the same time at the listener's ears. In addition to this compensating delay, an additional delay component $\tau t2$ is required for the precedence effect to be achieved. The total delay applied by the delay 213 is thus $\tau=\tau t1+\tau t2$.

The value of $\tau t2$ is not very critical, as long as it is between typically around 1 ms and the upper limit of the precedence effect, which depends on the signal type.

For the most critical type of signal, short clicks, the upper limit for $\tau t2$ is 5 ms, and therefore it may, in some scenarios, be advantageous to select the delay $\tau t2$ in the range of 1-5 ms. Such a delay may, for example, be used in scenarios where it is possible to carefully set up a configuration wherein the transmission path delay is well known and static.

However, the required value for the compensating delay $\tau t1$ (the transmission path delay) is very dependent on the geometrical lay-out of the room, the loudspeaker placement and the listening position, and is, in typical configurations, in the range of a few to several tens of milliseconds (say, 3-30 ms). This means that with a small value of $\tau t2$ between 1-5 ms, the total required delay $\tau$ is very much determined by the exact value of $\tau t1$, and it is necessary to set the value of $\tau t1$ carefully to correspond to the actual geometrical configuration.

In some embodiments, the delay 213 may accordingly be a delay which can be varied in response to the transmission path delay value for the transmission path from the high frequency loudspeaker 203 to the listening position 111. The transmission path delay value for the high frequency loudspeaker 203 may be reduced by the transmission path delay value for the transmission path from the low frequency loudspeaker 205 to the listening position 111 thereby generating a transmission path delay difference value which is used to offset for the path variation.

The transmission path delay compensation may be performed manually by a user, e.g., manually setting the relative transmission path delay $\tau t1$. This setting may, e.g., be based on a measurement of the two physical path lengths by the user, or by having the user manually adjust a delay control until the desired effect is perceived.

As another example, a microphone may be placed in the listening position 111 and coupled to the drive circuit 201. A measurement signal from the microphone may then be used to adapt the delay 213 such that it compensates for both the transmission path delay difference and provides the desired precedence effect. For example, a ranging distance measurement process may be performed by radiating calibration signals from the high frequency loudspeaker 203 and the low frequency loudspeaker 205, respectively.

Thus, in the described example, the system is arranged to introduce a delay which is no more than 40 msec. higher than a transmission path delay difference between a transmission path from the high frequency loudspeaker 203 to the listening position 111 and a path from the low frequency loudspeaker 205 to the listening position 111. Indeed, in many embodiments, the delay is advantageously no more than 15 msec. or even 5 msec. higher than this transmission path delay difference. Indeed, this may be achieved by a calibration and adaptation of the system based on a determination of the transmission path delay difference and/or may be achieved by controlling the location of speakers for the specific room characteristics.

In order to make the system less sensitive to the actual geometrical configuration, it may, in some embodiments, be preferred to set the value of $\tau t2$ relatively high. An advantage of this approach, in many scenarios, is that in most cases there will then be no need to set the delay $\tau t1$ according to the specific configuration, i.e., the same delay will be suitable for relatively high variations in the transmission path delay difference. However, since $\tau t2$ may be set higher than 5 ms, the precedence effect may no longer work perfectly for very short signals, such as transients in percussive music.

The system of FIG. 2 may specifically be used for a surround channel of a surround sound multi-channel audio signal. The surround channel may specifically be a side or rear channel of a surround sound system and may be used to provide the spatial experience of a side or rear speaker. Thus, the system may be arranged such that the sound from the high frequency loudspeaker 203 arrives at the listening position (111) from a non-frontal direction, i.e., from the side or from the rear. The frontal directions may be all directions between the front left and front right speakers, or may more specifically be determined as angles of less than 60 degree relative to the direction from the listening position to the nominal position of a front center channel (corresponding to the direction from the listening position to the center speaker).

For example, the approach of FIG. 2 may advantageously be used to provide one of the rear speakers 107, 109 of FIG. 1.

The approach may in particular be used to locate the high frequency loudspeaker 203 at a desired position of the surround channel, i.e., at a position corresponding to an appropriate position for the surround channel sound source. This may advantageously be in a non-frontal direction and specifically outside a front direction angle interval of less than 60 degrees relative to the direction from the listening position 111 to a nominal position for the surround sound center channel (typically corresponding to the position of the center speaker). Thus, the high frequency loudspeaker 203 is positioned to the side or rear of the user as desired. E.g., if the system of FIG. 2 is used to replace the left rear speaker 107 of FIG. 1, then the high frequency loudspeaker 203 is placed at the position of the left rear speaker.

Figure 5:
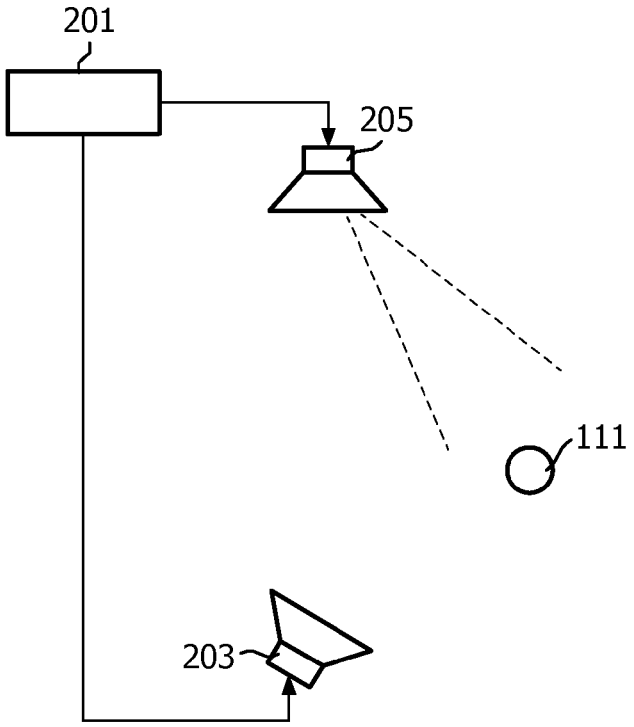
FIG. 5 illustrates an example of elements of a speaker system in accordance with some embodiments of the invention.

However the low frequency loudspeaker 205 is not co-located with the high frequency loudspeaker 203 but is located remote from this. In particular, the low frequency loudspeaker 205 may be located in a frontal direction (e.g., within 60 degrees of the central direction). An example of such a setup is illustrated in FIG. 5.

In comparison to conventional surround sound systems, this approach has the substantial advantage that the rear speaker can be very small. The small form factor may, in particular, be achieved due to the use of a relatively high crossover frequency, say 800 Hz, which is much higher than what can be achieved in conventional subwoofer-based systems. The high crossover frequency allows an unobtrusive, low-power and possibly even wireless speaker to be used to the rear of the listener. Furthermore, the use of the directional low frequency loudspeaker 205 to radiate the mid/low frequency portion of the surround channels provides a very convincing perception of a full-range rear source, rather than the tinny sound typically associated with small satellite speakers.

Furthermore, as the position of the low frequency loudspeaker 205 is not critical to the perceived spatial origin of the surround channel, it may be positioned relatively freely. In particular, it may often be co-located with, e.g., the corresponding front side speaker, e.g., with the front left speaker 103 in the present example. Indeed, it is possible to combine the low frequency loudspeaker 205 with the front left speaker 103 such that this reproduces both the left front channel and the low/mid frequency components of the left rear channel. This may reduce cost and reduce the number/size of speakers required for the surround sound system.

Figure 6:
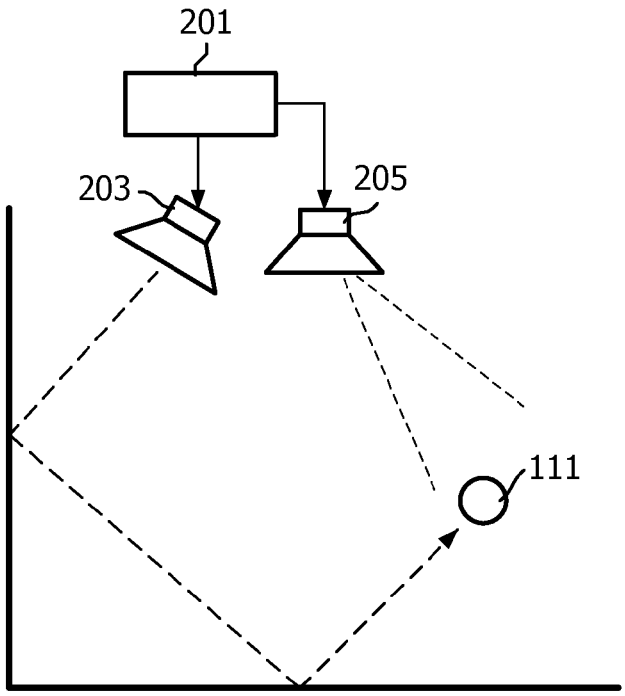
FIG. 6 illustrates an example of elements of a speaker system in accordance with some embodiments of the invention.

In some embodiments, the high frequency loudspeaker 203 may also be positioned in a frontal direction. For example, as illustrated in FIG. 6, the high frequency loudspeaker 203 may be implemented as a directional speaker which reaches the listening position 111 via reflections off walls. Such approaches for providing surround channels have been developed for providing a spatial surround experience from a single loudspeaker box. However, the approach provides a particularly suitable synergy in combination with the approach of FIG. 2. Specifically, the approach of FIG. 2 allows for a higher crossover frequency and thus allows for the signal to be reflected more accurately to provide the spatial perception. Indeed, the signal being reflected can be restricted to higher frequencies that can more accurately be controlled and reflected. Thus, an improved spatial experience is achieved. Furthermore, speakers for such reflected systems are typically implemented using a plurality of driver units which are individually phase offset to provide directional audio beams in the desired direction. However, this functionality may be reused to also provide the desired directionality of the low frequency loudspeaker 205. Thus, the same driver units can be used to provide both the directional low frequency sound reproduction of the low frequency loudspeaker 205 and the directional high frequency sound reproduction of the high frequency loudspeaker 203.

In some embodiments, the high frequency loudspeaker 203 may be in an audiovisual reproduction device whereas the low frequency loudspeaker 205 may be remote from the audiovisual reproduction device. The audiovisual reproduction device may be any device capable of reproducing audiovisual material and in particular material with associated audio and video.

The approach may, for example, be used to integrate the high frequency loudspeaker 203 with a flat screen television whereas the low frequency loudspeaker 205 is provided as a separate box that can be placed more freely, such as, e.g., on the floor to the side of the television. This may be highly beneficial as flat screen televisions are characterized by being very flat and having a very slim bezel thereby rendering it very difficult to integrate loudspeakers that are capable of reproducing full-range audio. In this use case, the described approach can be used to combine a small high-frequency tweeter integrated in the television with a separate freely-placeable low-mid loudspeaker with a radiation pattern having a notch in the direction of the listener (e.g., a dipole speaker) and a suitable delay applied to its signal. This enables the perception of full-range sound coming from the television, while in reality only the high frequencies originate therefrom.

In some embodiments, the high frequency loudspeaker 203 may comprise a parametric loudspeaker in the form of a small, highly directional ultrasound speaker.

Specifically, the high frequency loudspeaker 203 may comprise a directional ultrasound transducer arranged to emit ultrasound towards a surface to reach the listening position via a reflection of at least that surface. For example, in the scenario of FIG. 6, the high frequency loudspeaker 203 may be an ultrasound transducer.

This may, for example, result in an improved virtual surround sound source being provided since as a highly directional ultrasonic signal is used rather than a conventional audio band signal which cannot be controlled to the same degree. The approach may allow a reduced spatial degradation due to unintended signal paths from the directional ultrasound transducer to the listener. For example, the directional ultrasound transducer may be located to the front of the listener but angled away from the listener towards a wall for reflection. In such a scenario, a much reduced and often insignificant amount of sound will be perceived to originate from the actual position of the directional ultrasound transducer. In particular, a much narrower and well defined audio beam for generating the virtual surround sound can be achieved thereby allowing improved control and an improved spatial experience to be generated.

Indeed, such ultrasound transducers have a highly directive sound beam. In general, the directivity (narrowness) of a loudspeaker depends on the size of the loudspeaker compared to the wavelengths. Audible sound has wavelengths ranging from a few inches to several feet, and because these wavelengths are comparable to the size of most loudspeakers, sound generally propagates omni-directionally. However, for an ultrasound transducer, the wavelength is much smaller and accordingly it is possible to create a sound source that is much larger than the radiated wavelengths thereby resulting in the formation of a very narrow and highly directional beam.

Such a highly directional beam can be controlled much better, and in the system of FIG. 6, it can be directed to the listening position 111 via well-defined reflections off the walls of the room. The reflected sound will reach the ears giving the listener the perception of having sound sources located at the back of the room. Similarly, by directing the ultrasound beam to the side wall or ceiling, it is possible to generate perceived sound sources to the side and above the listener, respectively.

Thus, the system of FIG. 6 uses an ultrasound transducer that has a very directive sound beam as, or as part of, a surround speaker that is located to the front of the listening position 111. This ultrasound beam can easily be directed to the side or back wall of the room such that the reflected sound will reach the listener's ears to provide the perception of having sound sources placed at the back of the room.

The ultrasonic signals are specifically generated by amplitude modulating an ultrasound carrier signal by the audio signal of the surround channel. This modulated signal is then radiated from the high frequency loudspeaker 203. The ultrasound signal is not directly perceivable by a human listener but the modulating audio signal can automatically become audible without the need for any specific functionality, receiver or hearing device. In particular, any nonlinearity in the audio path from the transducer to the listener can act as a demodulator thereby recreating the original audio signal that was used to modulate the ultrasound carrier signal. Such a non-linearity may occur automatically in the transmission path. In particular, the air as a transmission medium inherently exhibits a non-linear characteristic that results in the ultrasound becoming audible. Thus, in the example, the non-linear properties of the air itself cause the audio demodulation from a high intensity ultrasound signal. Thus, the ultrasonic signal may automatically be demodulated to provide the audio sound to the listener.

Examples and further description of the use of ultrasound transducers for audio radiation may, for example, be found in the PhD thesis "Sound from Ultrasound: The Parametric Array as an Audible Sound Source" by F. Joseph Pompei, 2002, Massachusetts Institute of Technology.

The use of an ultrasound radiation of the surround channels provides a very narrow beam. This allows for the reflections to be better defined and controlled and can in particular provide a more accurate control of the angle of arrival at the listening position. Thus, the approach may allow the virtual perceived position of the surround sound sources to be much better defined and controlled. Furthermore, the use of an ultrasound signal may allow such a position to be perceived to be closer to a point source, i.e., to be less smeared. Also, the narrow beam of an ultrasound transducer reduces the radiation of sound along other paths and specifically reduces the sound level of any sound reaching the listening position through a direct path.

Accordingly, the described approach typically provides for a substantially better defined virtual surround sound position to be perceived by the user. In particular, the spatial direction cues provided to the listener are substantially more accurate and are more homogenous and consistent with a sound source position behind (or to the side of the listener).

In some embodiments, the low frequency loudspeaker 205 comprises a plurality of audio drivers and the second drive circuit 211 is arranged to generate the second drive signal as individual phase offset signals for the plurality of audio drivers to generate an audio beam. Thus, in this approach, the low frequency loudspeaker 205 may use a plurality of audio drivers with individual phase adjustment to provide a directional radiation pattern. A low complexity example is illustrated in FIG. 3 where two audio drivers are driven out-of-phase to provide a dipole radiation pattern.

Figure 7:
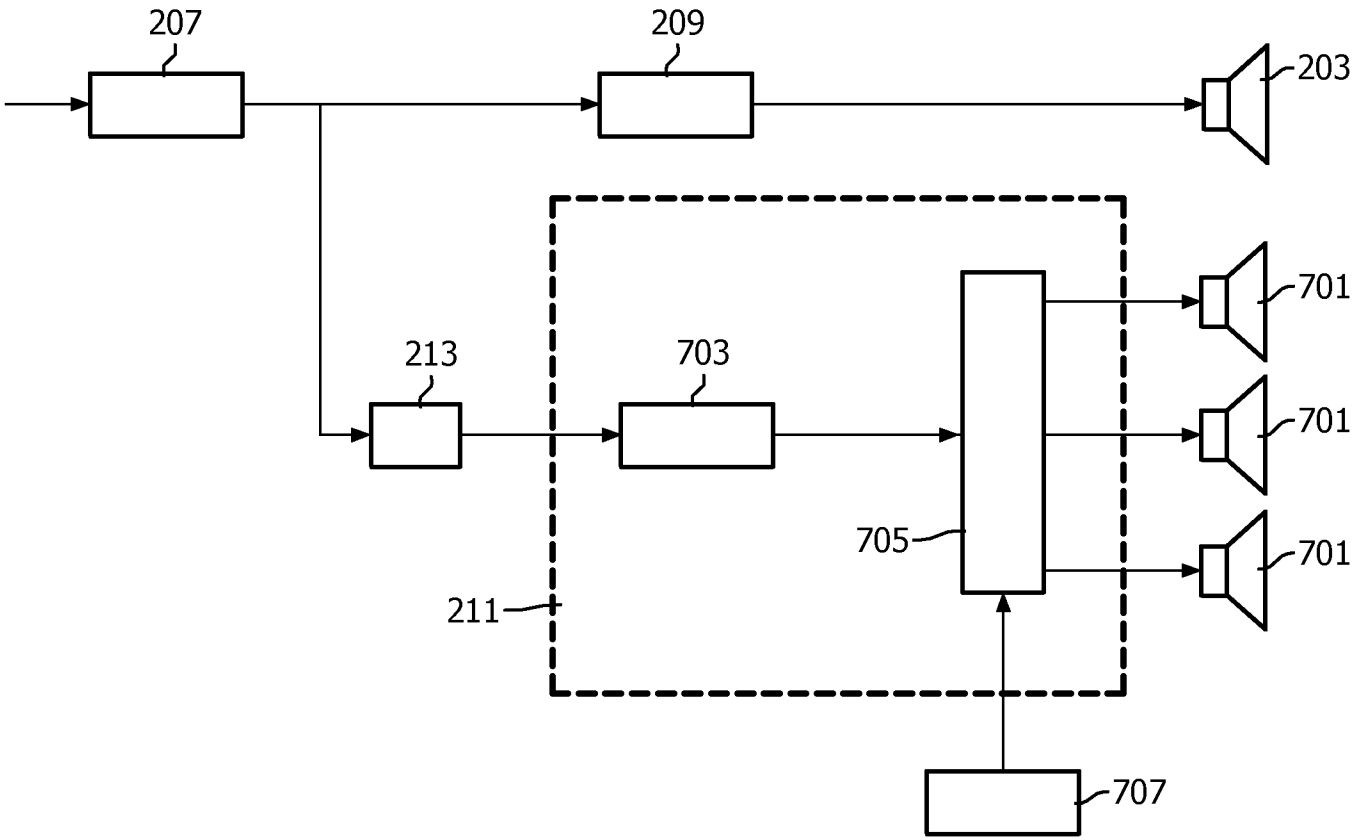
FIG. 7 illustrates an example of elements of a speaker system in accordance with some embodiments of the invention.

Another example is illustrated in FIG. 7. In this example, the low frequency loudspeaker 205 comprises three driver units 701 which can be individually controlled. The low frequency drive circuit 211 comprises a common drive circuit which includes common functionality such as filtering and amplification functions. The common signal is fed to a beamformer 705 which then generates the individual drive signal for the individual audio driver 701 by applying an individual weight for each audio driver 701. The weights allow the phase offset, and possibly the gain, for the drive signal of one of the audio drivers 701 to be set independently of the other audio drivers 701. By controlling the weights for the individual audio drivers 701, the resulting combined directional radiation pattern for the array of audio drivers 701 can be controlled as will be well known to the person skilled in the art.

In some embodiments, the beamformer 705 may provide a fixed static beamforming but in the example of FIG. 7, the system further comprises a processor 707 which controls the beamforming of the beamformer 705. For example, the processor 707 may provide a desired angle of a null of the directional radiation pattern to the beamformer 705 which in response determines the appropriate weights.

In some embodiments, the processor 707 may be arranged to receive a user input from a user. The user input may specifically indicate a desired direction and the beamformer 705 may then proceed to direct the null in the desired direction.

Thus, the system may allow the user to manually direct the notch towards a preferred listening position. For example, a listener may be asked to adjust a slider or similar control in a user interface until they perceive the strongest illusion, or the 'best sound'. Thus, a very simple approach for customizing the system to the specific environment may be achieved.

In some embodiments, the processor 707 may be arranged to dynamically estimate a direction from the low frequency loudspeaker 205 to the listening position and the estimated direction may be fed to the beamformer 705 to provide a notch in the corresponding direction.

It will be appreciated that the skilled person will be aware of various approaches for estimating the direction to a point in space and that any suitable approach may be used without detracting from the invention.

Such a system may be particularly efficient in tracking the movement of a listening position in scenarios where this is, e.g., considered to correspond to the position of a listener. Indeed, the strength of the spatial illusion depends on the notch being directed towards the listener. If the listener moves out of this notch, the illusion of full-range sound originating from the high frequency loudspeaker 203 will be much reduced. Therefore, controlling the notch based on a tracking approach may enable the system to automatically adjust to the user position.

As specific examples, the direction determination may be based on ultrasound range detection, infra-red sensors, RFID token based (where the listener would carry an RFID tag on their person or embedded in the remote), or may be video based.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by, e.g., a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A speaker system comprising:

a first speaker arranged to reproduce sound in response to a first drive signal, the first speaker being arranged to reproduce sound to arrive at a listening position;

a second speaker arranged to reproduce sound in response to a second drive signal; and a driving circuit, wherein the driving circuit comprises:

a receiver for receiving an audio signal for reproduction;

a first drive circuit for generating the first drive signal in response to a first filtering of the audio signal, the first filtering having a first passband;

a second drive circuit for generating the second drive signal in response to a second filtering of the audio signal, the second filtering having a second passband, the second passband comprising a frequency band below the first frequency band; and a delay for delaying the second drive signal relative to the first drive signal, and wherein the second speaker is arranged to directionally radiate all sound from the second speaker with a directional radiation pattern having a notch towards the listening position.

2. The speaker system as claimed in claim 1, wherein an angle between a direction from the listening position to the first speaker and a direction from the listening position to the second speaker is no less than 60 degrees.

3. The speaker system as claimed in claim 1, wherein the audio signal is a signal of a surround channel of a surround sound multi-channel audio signal and the first speaker is arranged such that the sound from the first speaker arrives at the listening position from a non-frontal direction.

4. The speaker system as claimed in claim 2, wherein the first speaker is part of a surround sound system and is positioned outside a front direction angle interval for the surround sound system, the front direction interval comprising angles less than 60 degrees offset relative to a direction from the listening position to a surround sound center channel audio source.

5. The speaker system as claimed in claim 1, wherein the notch in the directional radiation pattern of the second speaker comprises an intensity of the sound from the second speaker in the direction of the listening position being no less than 10 dB below a maximum intensity of the sound from the second speaker.

6. The speaker system as claimed in claim 1, wherein the first passband has a lower 3 dB cut-off frequency that belongs to a frequency range of 400 Hz to 1 kHz.

7. The speaker system as claimed in claim 1, wherein a frequency of equal gain for the first passband and the second passband belongs to a frequency range of 400 Hz to 1 kHz.

8. The speaker system as claimed in claim 1, wherein the first filtering is a high-pass filtering and the second filtering is a low-pass filtering.

9. The speaker system as claimed in claim 1, wherein the delay is arranged to delay the second drive signal relative to the first drive signal by no more than 40 msec more than a transmission path delay difference between a transmission path from the first speaker to the listening position and a direct path from the second speaker to the listening position.

10. The speaker system as claimed in claim 1, wherein the first speaker comprises a parametric speaker.

11. The speaker system as claimed in claim 1, wherein the second speaker comprises a plurality of audio drivers and the second drive circuit is arranged to generate the second drive signal as individual phase offset signals for the plurality of audio drivers to provide the directional radiation pattern.

12. The speaker system as claimed in claim 1, wherein the first speaker is integrated in an audiovisual reproduction device whereas the second speaker is remote from the audiovisual reproduction device.

13. The speaker system as claimed in claim 1, wherein said speaker system further comprises:

an estimator for dynamically generating a direction estimate for a direction from the second speaker to the listening position; and a controller for modifying the directional radiation pattern to provide the notch in the estimated direction.

14. The speaker system as claimed in claim 1, wherein said speaker system further comprises:

a user input for receiving a direction indication from a user; and a controller for modifying the directional radiation pattern of the second speaker to provide the notch in a direction indicated by the direction indication.

15. A method of operation for a speaker system including:

a first speaker arranged to reproduce sound in response to a first drive signal, the first speaker being arranged to reproduce sound to arrive at a listening position;

a second speaker arranged to reproduce sound in response to a second drive signal; the method comprising:

receiving an audio signal for reproduction, generating the first drive signal in response to a first filtering of the audio signal, the first filtering having a first passband, generating the second drive signal in response to a second filtering of the audio signal, the second filtering having a second passband, the second passband comprising a frequency band below a frequency band of the first passband; and delaying the second drive signal relative to the first drive signal, wherein all the sound from the second speaker is directionally radiated with a directional radiation pattern having a notch towards the listening position.

* * * * *